US012559955B2

(12) United States Patent
Ineyama

(10) Patent No.: US 12,559,955 B2
(45) Date of Patent: Feb. 24, 2026

(54) CONCRETE VIBRATOR

(71) Applicant: HONDA MOTOR CO., LTD., Tokyo (JP)

(72) Inventor: Ryo Ineyama, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 793 days.

(21) Appl. No.: 17/881,304

(22) Filed: Aug. 4, 2022

(65) Prior Publication Data

US 2024/0044158 A1 Feb. 8, 2024

(51) Int. Cl.
*E04G 21/00* (2006.01)
*E04G 21/08* (2006.01)

(52) U.S. Cl.
CPC ..... *E04G 21/08* (2013.01)

(58) Field of Classification Search
CPC ..... E04G 21/08; E04G 21/061; E04G 21/06; E04G 21/04
See application file for complete search history.

(56) References Cited

U.S. PATENT DOCUMENTS

2008/0253221 A1* 10/2008 Lindley ..... E04G 21/066 366/128
2014/0241105 A1* 8/2014 Jin ..... E04G 21/08 366/64
2019/0234084 A1* 8/2019 Coughlan ..... E04G 21/08
2021/0148126 A1* 5/2021 Gallagher ..... E04G 21/08

FOREIGN PATENT DOCUMENTS

JP 2011236667 A 11/2011

* cited by examiner

*Primary Examiner* — Anshu Bhatia
(74) *Attorney, Agent, or Firm* — Armstrong Teasdale LLP

(57) ABSTRACT

A concrete vibrator (1) includes: a vibration generating member (4) that includes a rotating body (3) and generates vibration according to rotation of the rotating body (3); an electric motor (5) that applies a rotational driving force to the rotating body (3); a support member (7) that supports the electric motor (5); and a battery (8) that supplies electric power to the electric motor (5), wherein the battery (8) is disposed above the electric motor (5).

9 Claims, 5 Drawing Sheets

CONCRETE VIBRATOR

TECHNICAL FIELD

The present invention relates to a concrete vibrator.

BACKGROUND ART

Conventionally, there is known a concrete vibrator for applying vibration to uncured concrete poured into the mold or the like thereby to remove bubbles from the concrete.

For example, JP2011-236667A discloses a concrete vibrator including a commutator motor (driving motor) and a gear box coupled to the output shaft of the commutator motor.

However, the above concrete vibrator is not provided with a battery for supplying electric power to the commutator motor. Therefore, to operate the commutator motor, it is necessary to supply electric power to the commutator motor from an outside, fixed power supply via a cable. As a result, the installation range of the concrete vibrator may be limited by the cable range.

Also, in the above concrete vibrator, the commutator motor and the gear box are arranged side-by-side in the horizontal direction. Therefore, it is difficult to dispose the concrete vibrator compactly in the horizontal direction.

SUMMARY OF THE INVENTION

In view of the foregoing background, an object of the present invention is to provide a concrete vibrator which has a high degree of freedom of the installation range and can be disposed compactly in the horizontal direction.

To achieve the above object, one aspect of the present invention provides a concrete vibrator (1), comprising: a vibration generating member (4) that includes a rotating body (12) and generates vibration according to rotation of the rotating body; an electric motor (5) that applies a rotational driving force to the rotating body; a support member (7) that supports the electric motor; and a battery (8) that supplies electric power to the electric motor, wherein the battery is disposed above the electric motor.

According to this aspect, the concrete vibrator is provided with a battery that supplies electric power to the electric motor. Therefore, it is unnecessary to supply electric power to the electric motor from an outside, fixed power supply via a cable. Accordingly, the degree of freedom of the installation range of the concrete vibrator can be enhanced. Also, the battery is disposed above the electric motor. Therefore, the concrete vibrator can be disposed compactly in the horizontal direction.

In the above aspect, preferably, the electric motor has a motor shaft (22) extending in a horizontal direction, and the battery is disposed right above the motor shaft.

According to this aspect, members around the motor shaft (for example, the housing of the electric motor) can be pressed down by the battery. Thereby, the vibrations generated in the members around the motor shaft when the motor shaft is rotated can be suppressed.

In the above aspect, preferably, the concrete vibrator further comprises a transmission member (6) that transmits the rotational driving force of the electric motor to the rotating body, the electric motor has an output port (24) to which the transmission member is detachably connected, and the output port extends in a horizontal direction.

According to this aspect, interference between the battery disposed above the electric motor and the transmission member can be avoided.

In the above aspect, preferably, the battery comprises: a battery pack (61); and a battery case (62) detachably accommodating the battery pack.

According to this aspect, by attaching and detaching the battery pack to and from the battery case, it is possible to replace the power supply of the electric motor without moving the electric motor. Therefore, convenience is improved in a case where the concrete vibrator is used with the electric motor installed in a fixed position.

In the above aspect, preferably, the battery pack is disposed such that a length thereof in a vertical direction is shorter than a length thereof in a horizontal direction.

According to this aspect, the center of gravity of the concrete vibrator can be lowered. Accordingly, the stability of the concrete vibrator can be enhanced.

In the above aspect, preferably, the concrete vibrator further comprises a transmission member (6) that transmits the rotational driving force of the electric motor to the rotating body, wherein the electric motor includes an output port (24) to which the transmission member is detachably connected, and an attachment and detachment direction (D2) of the battery pack relative to the battery case coincides with an attachment and detachment direction (D1) of the transmission member relative to the output port.

According to this aspect, attachment and detachment of the battery pack can be performed by using a space for performing attachment and detachment of the transmission member. Thereby, interference between the battery pack and other components (for example, the support member) can be prevented.

In the above aspect, preferably, the electric motor has a motor shaft (22) extending in a horizontal direction, the support member includes a pair of side frames (51) which, as viewed in an axial direction of the motor shaft, are disposed on either side of the electric motor in the horizontal direction, and the battery is disposed between the pair of side frames as viewed in the axial direction of the motor shaft.

According to this aspect, the concrete vibrator can be disposed more compactly in the horizontal direction.

In the above aspect, preferably, the support member further comprises: a lower frame (52) connecting lower ends of the pair of side frames; and an upper frame (53) connecting upper ends of the pair of side frames, wherein the battery is disposed to be surrounded by the pair of side frames, the lower frame, and the upper frame as viewed in the axial direction of the motor shaft.

According to this aspect, the concrete vibrator can be disposed compactly not only in the horizontal direction but also in the vertical direction.

In the above aspect, the battery may be placed on the electric motor.

According to this aspect, the electric motor can be used as a support part for the battery. Therefore, the battery can be disposed above the electric motor without complicating the configuration of the support member.

In the above aspect, the battery may be disposed to be spaced from the electric motor in a vertical direction.

According to this aspect, heat transfer between the battery and the electric motor can be suppressed.

Thus, according to one embodiment of the present invention, it is possible to provide a concrete vibrator which has a high degree of freedom of the installation range and can be disposed compactly in the horizontal direction.

DETAILED DESCRIPTION OF THE INVENTION

Concrete Vibrator 1

In the following, a concrete vibrator 1 according to one embodiment of the present invention will be described with reference to the drawings. The concrete vibrator 1 is a device for applying vibration to uncured concrete C poured into a mold F or the like thereby to remove bubbles from the concrete C.

Figure 1:
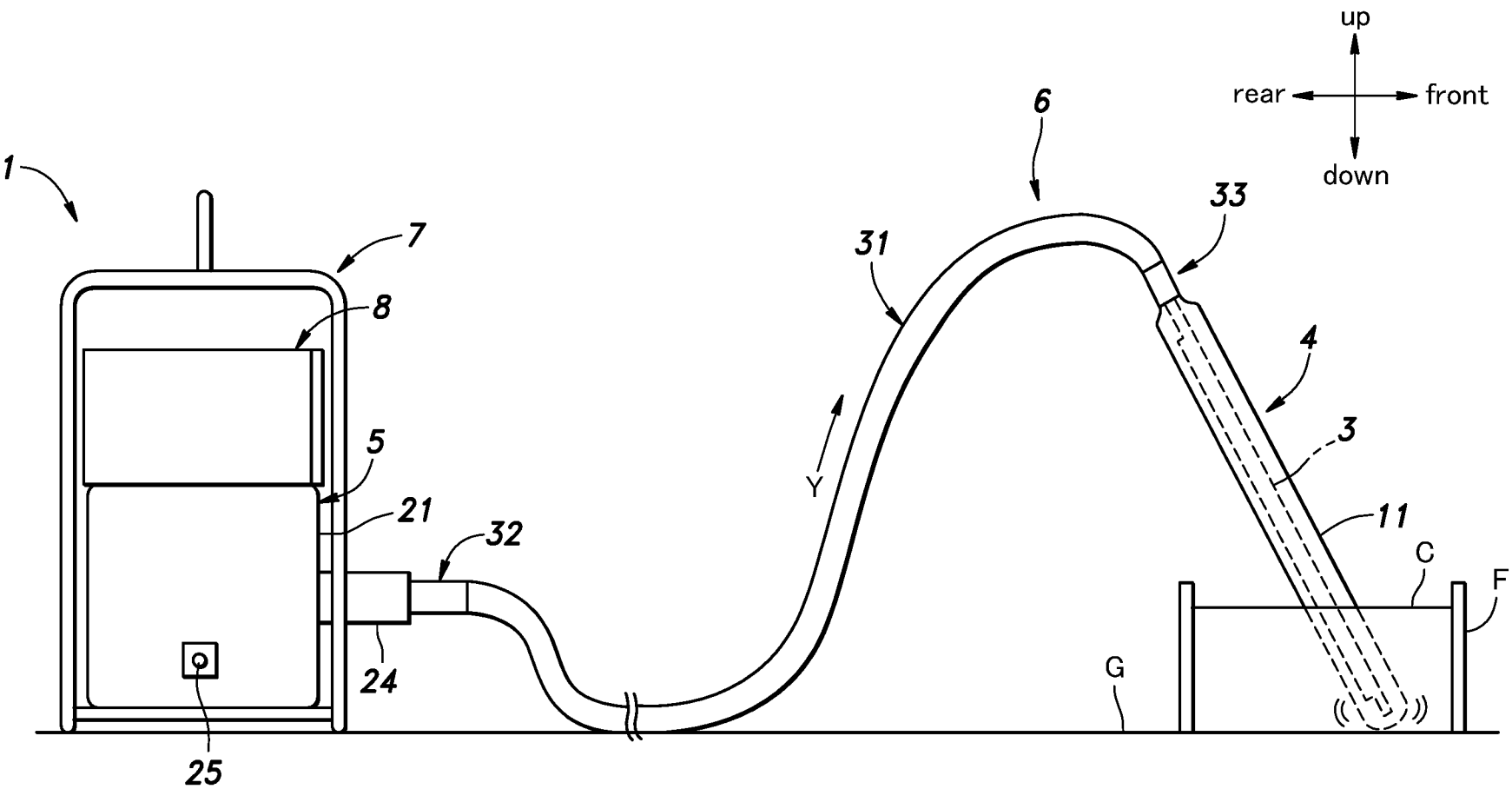
FIG. 1 is a side view showing a concrete vibrator according to one embodiment of the present invention.

Referring to FIG. 1, the concrete vibrator 1 includes a vibration generating member 4 that includes a rotating body 3 and generates vibration according to rotation of the rotating body 3, an electric motor 5 that applies a rotational driving force to the rotating body 3, a transmission member 6 that transmits the rotational driving force of the electric motor 5 to the rotating body 3, a support member 7that supports the electric motor 5, and a battery 8 that supplies electric power to the electric motor 5. In the following, these components of the concrete vibrator 1 will be described in order.

Vibration Generation Member 4

Figure 2:
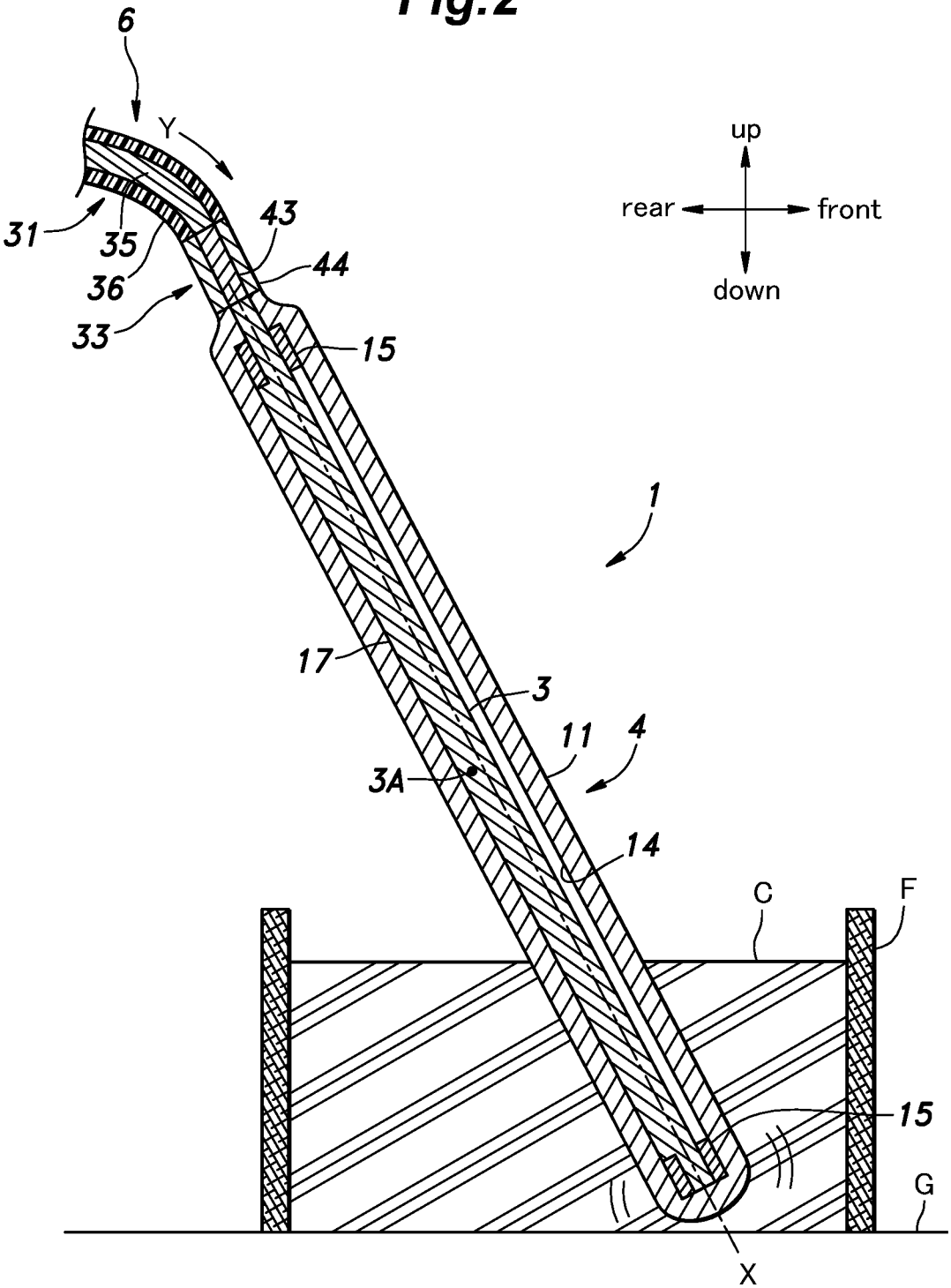
FIG. 2 is a sectional view showing a vibration generating member and its surroundings related to the embodiment of the present invention.

Referring to FIG. 2, the vibration generating member 4 of the concrete vibrator 1 includes a vibrating case 11 and a rotating body 3 contained in the vibrating case 11.

The vibrating case 11 is constituted of a bottomed cylinder elongated in a predetermined direction. The vibrating case 11 has an internal space 14 having an elongated hole shape. A pair of bearings 15 are disposed at respective end portions of the internal space 14. In another embodiment, one bearing 15 may be disposed at only one end portion of the internal space 14.

The rotating body 3 is mounted to the vibrating case 11 via the pair of bearings 15. Thereby, the rotating body 3 is rotatable about a vibration axis X extending in the longitudinal direction of the vibrating case 11. The rotating body 3 has a projection 17 that protrudes toward one side in the radial direction with the vibration axis X being the center. Therefore, the center of gravity 3A of the rotating body 3 is out of alignment with the vibration axis X. In other words, the rotating body 3 is eccentric to the vibration axis X.

Electric Motor 5

Figure 3:
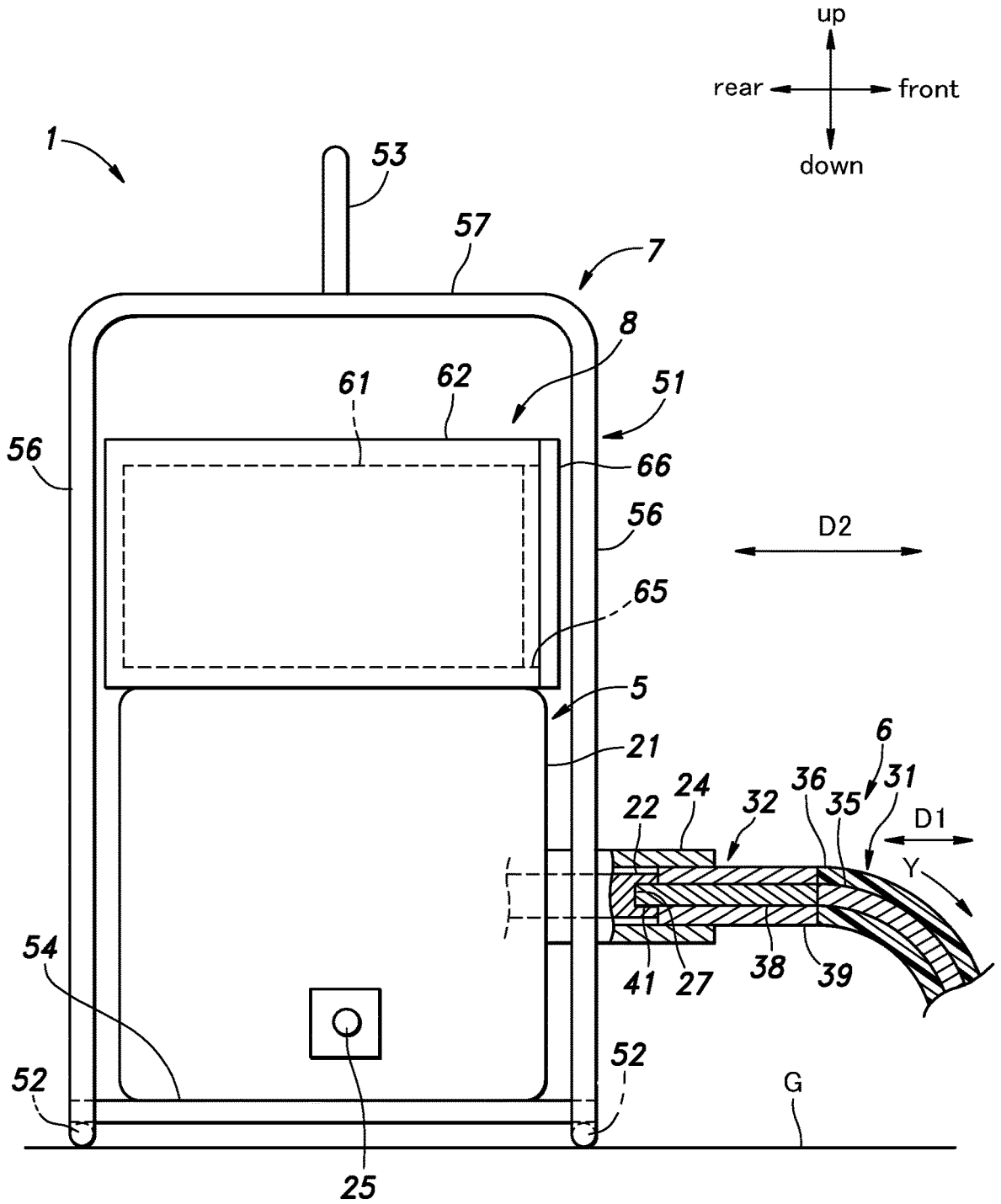
FIG. 3 is a partial sectional view showing an electric motor and its surroundings related to the embodiment of the present invention.
Figure 4:
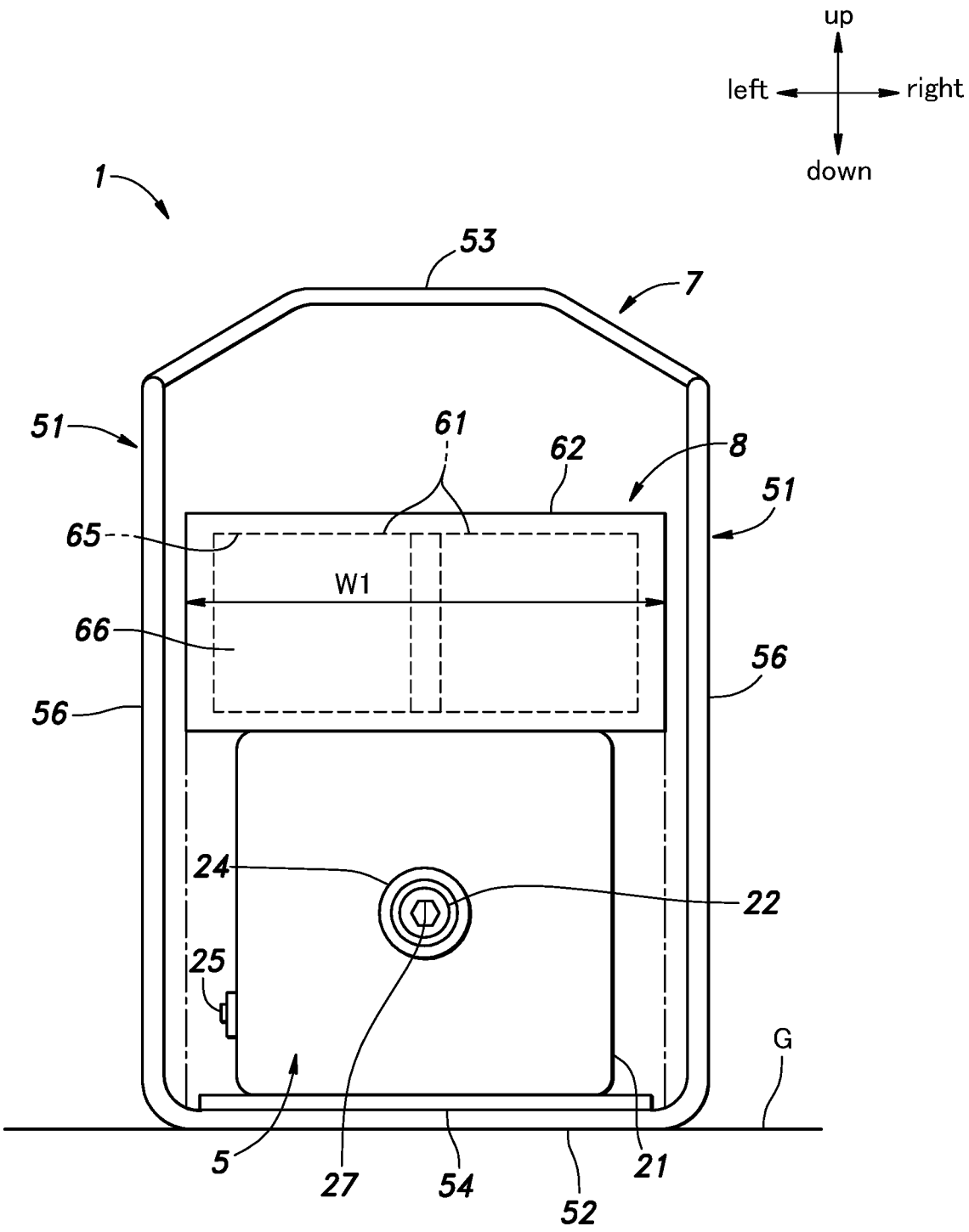
FIG. 4 is a front view showing the electric motor and its surroundings related to the embodiment of the present invention.

Referring to FIGS. 3 and 4, the electric motor 5 of the concrete vibrator 1 includes a housing 21 and a motor shaft 22 rotatably accommodated in the housing 21.

An output port 24 protrudes from the front surface of the housing 21. The output port 24 is cylindrical in shape and extends in the fore and aft direction. A power supply switch 25 is provided on a side surface of the housing 21.

The motor shaft 22 extends in the fore and aft direction (horizontal direction). In other words, the axial direction of the motor shaft 22 coincides with the fore and aft direction. A tip end portion of the motor shaft 22 is inserted in the output port 24. The tip end portion of the motor shaft 22 is provided with a non-circular fitting hole 27.

Transmission Member 6

In the following, recitation of "upstream-side" or "upstream end" refers to the upstream-side or the upstream end with respect to a rotation transmission direction Y (see FIGS. 1 to 3). Similarly, recitation of "downstream-side" or "downstream end" refers to the downstream-side or the downstream end with respect to the rotation transmission direction Y.

Referring to FIGS. 1 to 3, the transmission member 6 of the concrete vibrator 1 includes a flexible hose 31, an upstream-side joint 32 disposed on the upstream side of the flexible hose 31, and a downstream-side joint 33 disposed on the downstream side of the flexible hose 31.

The flexible hose 31 has flexibility. The flexible hose 31 includes a flexible shaft 35 and a flexible tube 36 that covers the outer circumference of the flexible shaft 35. The flexible shaft 35 is configured by stacked multiple wires, for example.

Referring to FIG. 3, the upstream-side joint 32 is detachably connected to the output port 24 of the electric motor 5. The attachment and detachment direction D1 of the upstream-side joint 32 relative to the output port 24 is the fore and aft direction.

The upstream-side joint 32 includes an upstream-side shaft 38 and an upstream-side tube 39 that covers the outer circumference of the upstream-side shaft 38. The upstream end of the upstream-side shaft 38 is provided with a non-circular fitting protrusion 41. In a state in which the upstream-side joint 32 is connected to the output port 24, the fitting protrusion 41 is fitted into the fitting hole 27 of the motor shaft 22 of the electric motor 5. Thereby, the upstream-side shaft 38 is connected o the motor shaft 22. The downstream end of the upstream-side shaft 38 is fixed to the upstream end of the flexible shaft 35 of the flexible hose 31.

Referring to FIG. 2, the downstream-side joint 33 includes a downstream-side shaft 43 and a downstream-side tube 44 that covers the outer circumference of the downstream-side shaft 43. The upstream end of the downstream-side shaft 43 is fixed to the downstream end of the flexible shaft 35 of the flexible hose 31. The downstream end of the downstream-side shaft 43 is fixed to the upstream end of the rotating body 3 of the vibration generating member 4.

Support Member 7

Referring to FIGS. 3 and 4, the support member 7 of the concrete vibrator 1 is installed on the ground G (one example of an installation surface for the concrete vibrator 1). The support member 7 includes a pair of side frames 51, a pair of lower frames 52 connecting the lower ends of the pair of side frames 51, an upper frame 53 connecting the upper ends of the pair of side frames 51, and a fixed plate 54 extending between the pair of lower frames 52.

The pair of side frames 51 forms an inverse U-shape as viewed in the lateral direction (namely, in side view). As viewed in the fore and aft direction (namely, in front view), the pair of side frames 51 are disposed on either lateral side (either horizontal side) of the electric motor 5. Each side frame 51 includes a pair of extension parts 56 disposed to be spaced from each other in the fore and aft direction and extending in the vertical direction and a connecting portion 57 extending in the fore and aft direction to connect the upper ends of the pair of extension parts 56.

The pair of lower frames 52 are in contact with the ground G. As viewed in the fore and aft direction, the pair of lower frames 52 are disposed below the electric motor 5. The pair of lower frames 52 are disposed to be spaced from each other in the fore and aft direction. The front lower frame 52 connects the lower ends of the front extension parts 56 of the pair of side frames 51. The rear lower frame 52 connects the lower ends of the rear extension parts 56 of the pair of side frames 51.

The upper frame 53 forms an inverse U-shape as viewed in the fore and aft direction. The upper frame 53 connects the central parts in the fore and aft direction of the connecting portions 57 of the pair of side frames 51. The upper frame 53 is a part to be grasped by a user when the user lifts the concrete vibrator 1.

The fixed plate 54 has a horizontal flat plate shape. The fixed plate 54 is disposed to be slightly spaced from the ground G. The electric motor 5 is placed on and secured to the fixed plate 54.

Battery 8

Referring to FIG. 3 and FIG. 4, the battery 8 of the concrete vibrator 1 is disposed above the electric motor 5. More specifically, the battery 8 is disposed right above the electric motor 5. In another embodiment, the battery 8 may be disposed obliquely above the electric motor 5. The battery 8 is placed on the electric motor 5 and is supported by the electric motor 5.

The left end of the battery 8 is positioned more leftward than the left end of the electric motor 5, and the right end of the battery 8 is positioned more rightward than the right end of the electric motor 5. In other words, in the present embodiment, the electric motor 5 is contained within the lateral (horizontal) width W1 of the battery 8 as viewed in the fore and aft direction. In another embodiment, the electric motor 5 does not have to be contained within the lateral width W1 of the battery 8.

The battery 8 is disposed between the pair of side frames 51 of the support member 7 as viewed in the fore and aft direction. The battery 8 is disposed to be surrounded by the pair of side frames 51, the front lower frame 52, and the upper frame 53 of the support member 7 as viewed in the fore and aft direction.

The battery 8 includes multiple battery packs 61 and a battery case 62 detachably accommodating the multiple battery packs 61.

Each battery pack 61 is disposed such that the length thereof in the vertical direction is shorter than the length thereof in the fore and aft direction (the length thereof in the horizontal direction). In other words, the battery pack 61 is disposed horizontally. Note that in another embodiment, the battery pack 61 may be disposed such that the length thereof in the vertical direction is longer than the length thereof in the fore and aft direction.

The battery pack 61 is constituted of a secondary battery such as a lithium ion battery, for example. The battery pack 61 is connected to the electric motor 5 via a cable (not shown in the drawings) and is configured to supply electric power to the electric motor 5.

Referring to FIG. 3, the attachment and detachment direction D2 of the battery pack 61 relative to the battery case 62 is the fore and aft direction. In other words, the attachment and detachment direction D2 of the battery pack 61 relative to the battery case 62 coincides with the attachment and detachment direction D1 of the upstream-side joint 32 of the transmission member 6 relative to the output port 24 of the electric motor 5.

The front surface of the battery case 62 is provided with an opening 65 for attachment and detachment of the battery pack 61. In another embodiment, the opening 65 may be provided in a surface of the battery case 62 other than the front surface (for example, the rear surface or the side surface). The opening 65 is covered by a cover 66 that can be opened and closed.

Bubble Removing Work

Next, bubble removing work using the above-described concrete vibrator 1 will be described. The bubble removing work is work for removing bubbles from uncured concrete C poured into the mold F or the like. The bubble removing work is performed in a state in which the electric motor 5, the support member 7, and the battery 8 are installed in fixed positions. In other words, the concrete vibrator 1 is an installation-type device.

When performing the bubble removing work, the user inserts the vibration generating member 4 into the concrete C and then turns the power supply switch 25 of the electric motor 5 from OFF to ON. Note that the user may turn the power supply switch 25 of the electric motor 5 from OFF to ON before inserting the vibration generating member 4 into the concrete C.

When the user turns the power supply switch 25 of the electric motor 5 from OFF to ON as described above, the electric motor 5 is put into operation and the motor shaft 22 of the electric motor 5 rotates. The rotation of the motor shaft 22 of the electric motor 5 is transmitted to the rotating body 3 of the vibration generating member 4 via the upstream-side shaft 38, the flexible shaft 35, and the downstream-side shaft 43 of the transmission member 6. Thereby, the rotating body 3 rotates about the vibration axis X.

As described above, the rotating body 3 is eccentric to the vibration axis X. Therefore, when the rotating body 3 rotates about the vibration axis X, the vibration generating member 4 generates vibration. The vibration generated by the vibration generating member 4 is transmitted to the concrete C and the concrete C is vibrated. Thereby, bubbles are removed from the concrete C.

Effects

As described in the foregoing, the concrete vibrator 1 is provided with the battery 8 that supplies electric power to the electric motor 5. Therefore, it is unnecessary to supply electric power to the electric motor 5 from an outside, fixed power supply via a cable. Accordingly, the degree of freedom of the installation range of the concrete vibrator 1 can be enhanced. Also, the battery 8 is disposed above the electric motor 5. Therefore, the concrete vibrator 1 can be disposed compactly in the horizontal direction.

Incidentally, if during execution of the bubble removing work, the user inadvertently pulls the vibration generating member 4 in a direction opposite from the electric motor 5 while the transmission member 6 is fully stretched, the electric motor 5 may fall. However, in the present embodiment, since the battery 8 is disposed above the electric motor 5, the battery 8 serves as a weight for the electric motor 5 and this improves the stability of the electric motor 5. Therefore, even if the user inadvertently pulls the vibration generating member 4 in a direction opposite from the electric motor 5 while the transmission member 6 is fully stretched, the electric motor 5 is less likely to fall.

Also, by attaching and detaching each battery pack 61 to and from the battery case 62, it is possible to replace the power supply of the electric motor 5 without moving the electric motor 5. Therefore, convenience is improved in a case where the concrete vibrator 1 is used with the electric motor 5 installed in a fixed position. Further, when the concrete vibrator 1 is not in use, it is possible to remove one or more battery packs 61 from the battery case 62 and to use them in a work other than the bubble removing work (for example, another work included in the entire work including the bubble removing work). Thus, convenience of the battery packs 61 can be enhanced.

Modification

Figure 5:
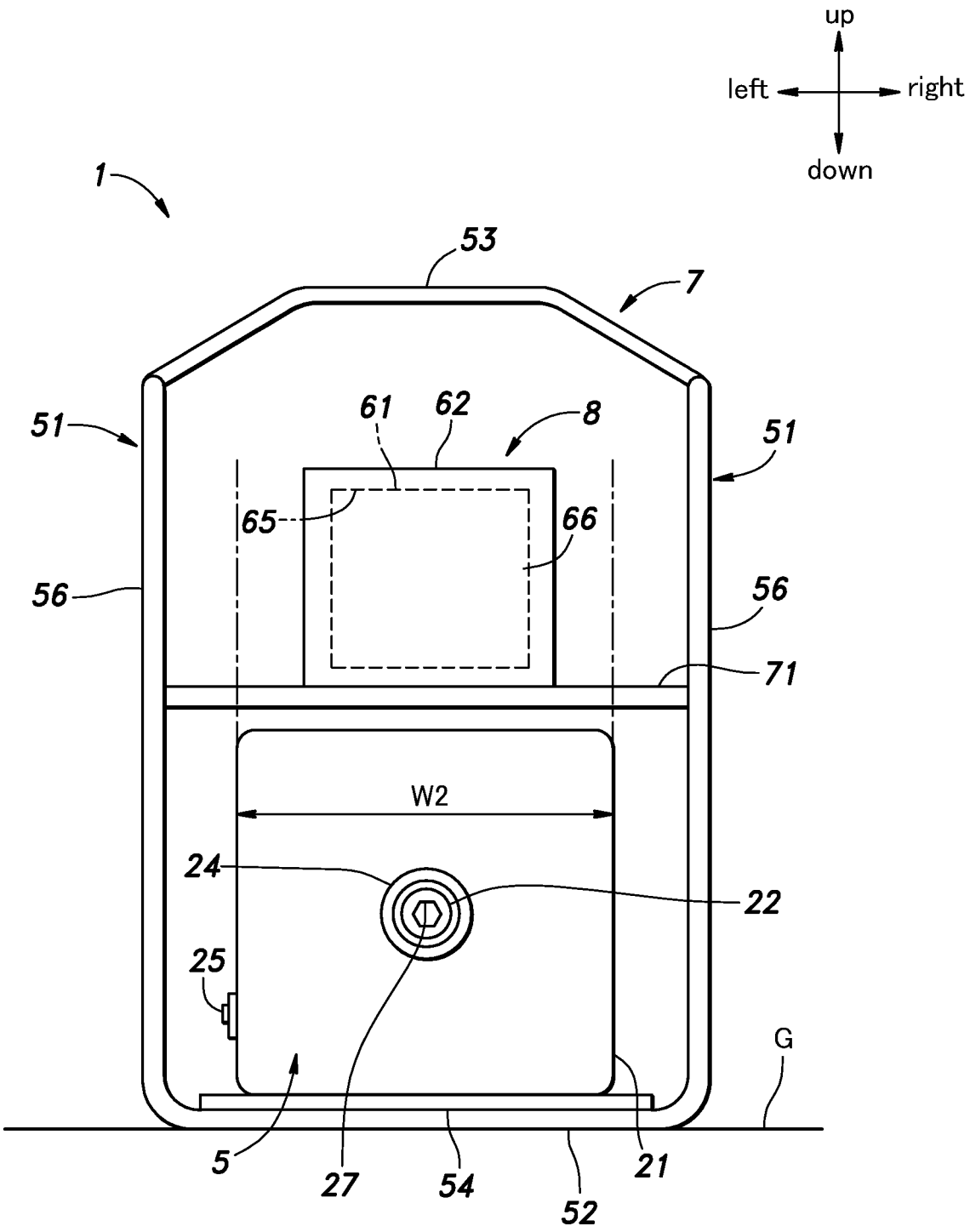
FIG. 5 is a front view of an electric motor and its surroundings related to another embodiment of the present invention.

In the above embodiment, the battery 8 includes multiple battery packs 61. In another embodiment, the battery 8 may include only one battery pack 61, as shown in FIG. 5.

In the above embodiment, the electric motor 5 is contained within the lateral width W1 of the battery 8 as viewed in the fore and aft direction. In another embodiment, the battery 8 may be contained within the lateral width W2 of the electric motor 5 as viewed in the fore and aft direction, as shown in FIG. 5.

In the above embodiment, the battery 8 is placed on the upper surface of the electric motor 5. In another embodiment, the battery 8 may be disposed to be spaced from the electric motor 5 in the vertical direction, as shown in FIG. 5. In this case, the support member 7 may include a partition plate 71 that extends between the pair of side frames 51 so that the battery 8 is placed on the partition plate 71.

Concrete embodiments of the present invention have been described in the foregoing, but the present invention is not limited to the above embodiment and modification and may be modified or altered in various ways.

The invention claimed is:

1. A concrete vibrator, comprising:

a vibration generating member that includes a rotating body and generates vibration according to rotation of the rotating body;

an electric motor that applies a rotational driving force to the rotating body;

a support member that supports the electric motor; and a battery that supplies electric power to the electric motor, wherein the electric motor has a motor shaft extending in a horizontal direction, and an entirety of the battery is disposed above the electric motor, wherein the support member includes a pair of side frames which, as viewed in an axial direction of the motor shaft, are disposed on either side of the electric motor in the horizontal direction, and the battery is disposed between the pair of side frames as viewed in the axial direction.

2. The concrete vibrator according to claim 1, further comprising a transmission member that transmits the rotational driving force of the electric motor to the rotating body, wherein the electric motor has an output port to which the transmission member is detachably connected, and the output port extends in a horizontal direction.

3. The concrete vibrator according to claim 1, wherein the battery comprises:

a battery pack; and a battery case detachably accommodating the battery pack.

4. The concrete vibrator according to claim 3, wherein the battery pack is disposed such that a length thereof in a vertical direction is shorter than a length thereof in a horizontal direction.

5. The concrete vibrator according to claim 3, further comprising a transmission member that transmits the rotational driving force of the electric motor to the rotating body, wherein the electric motor includes an output port to which the transmission member is detachably connected, and an attachment and detachment direction of the battery pack relative to the battery case coincides with an attachment and detachment direction of the transmission member relative to the output port.

6. The concrete vibrator according to claim 1, wherein the support member further comprises:

a lower frame connecting lower ends of the pair of side frames; and an upper frame connecting upper ends of the pair of side frames, wherein the battery is disposed to be surrounded by the pair of side frames, the lower frame, and the upper frame as viewed in the axial direction of the motor shaft.

7. The concrete vibrator according to claim 1, wherein the battery is placed on the electric motor.

8. The concrete vibrator according to claim 1, wherein the battery is disposed to be spaced from the electric motor in a vertical direction.

9. A concrete vibrator, comprising:

a vibration generating member that includes a rotating body and generates vibration according to rotation of the rotating body;

an electric motor that applies a rotational driving force to the rotating body;

a support member that supports the electric motor; and a battery that supplies electric power to the electric motor, wherein the battery is disposed above the electric motor, the electric motor has a housing and a motor shaft extending in a horizontal direction and rotatably accommodated in the housing, and the battery is disposed right above the motor shaft.

* * * * *